US006062260A

United States Patent [19]

Yoshimura et al.

[11] Patent Number: 6,062,260

[45] Date of Patent: May 16, 2000

[54] DUAL PISTON PILOT VALVE

[75] Inventors: Shinichi Yoshimura, Ibaragiken, Japan; Robert William Dickman, Jasper; Alexander Montgomery Mlsna, Indianapolis, both of Ind.

[73] Assignee: SMC Pneumatics, Inc., Indianapolis, Ind.

[21] Appl. No.: 09/415,928

[22] Filed: Oct. 12, 1999

Related U.S. Application Data

[63] Continuation of application No. 09/095,786, Jun. 11, 1998, abandoned.

[51] Int. Cl.[7] ..... F15B 13/043

[52] U.S. Cl. ..... 137/596.16; 91/465; 137/596.14; 137/596.18

[58] Field of Search ..... 91/465; 137/596.14, 137/596.16, 596.18

[56] References Cited

U.S. PATENT DOCUMENTS 3,223,120 12/1965 Lansky et al. .
4,616,674 10/1986 Bardoll .
4,763,691 8/1988 Hahmann .
4,924,902 5/1990 Lewis et al. .
5,454,399 10/1995 Kazakis et al. .

FOREIGN PATENT DOCUMENTS 931694 7/1955 Germany .

*Primary Examiner*—Gerald A. Michalsky
*Attorney, Agent, or Firm*—Bose McKinney & Evans

[57] ABSTRACT

A dual piston pilot valve includes a housing forming first and second cylinders. A first spool is moveable in the first cylinder for engaging the a piston to effect movement of the first piston and a second spool is moveable in the second cylinder for engaging a second piston to effect movement of the second piston. The valve further includes a single pressurized fluid supply port communicating with both the first and second cylinders, a first output port communicating with the first cylinder, a second output port communicating with the second cylinder, a single exhaust port communicating with both the first and second cylinders, and a diaphragm engaging the housing and both the first and second pistons. The diaphragm is positioned between both the first and second spools and both the first and second seal regions of the first and second pistons to effect a seal between the single exhaust port and the first and second spools. Movement of the first piston is controlled independently from the movement of the second piston, and vice versa.

10 Claims, 3 Drawing Sheets

DUAL PISTON PILOT VALVE

This is a continuation of Application Ser. No. 09/095,786 filed Jun. 11, 1998, now abandoned.

FIELD OF THE INVENTION

This invention relates generally to pilot valves having a pressurized fluid supply port, output port, and exhaust port. More particularly, the invention concerns a dual piston pilot valve having four ports to achieve the same results as two separate pilot valves each having a piston and each having a pressurized fluid supply port, output port and exhaust port, i.e., six ports.

BACKGROUND OF THE INVENTION

In general, pilot valves are used to actuate cylinders and other devices. A conventional three port pilot valve includes a pressurized fluid supply port, an output port, and an exhaust port. The conventional three port pilot valve also includes a piston and control valve. The control valve controls movement of the piston to provide an open passage between the pressurized fluid supply port and the output port, and at the same time to provide a closed passage between the output port and the exhaust port. The control valve also controls movement of the piston to provide an open passage between the output port and exhaust port and to provide a closed passage between the pressurized fluid supply port and the output port.

In the past, at least a five port pilot valve has been required in order to operate more than one device. Because of various applications for pilot valves, different types of pilot valves having different port arrangements have been required to control various types of devices in these different applications. Thus, the user has been required to maintain an inventory of pilot valves of different sizes and with different port arrangements.

SUMMARY OF THE INVENTION

The present invention is directed to a one piece pilot valve having four ports which achieves the same objectives as two three port pilot valves. Because of the one piece construction of the present invention, the quantity of pilot valves that need to be maintained in inventory is reduced. Further, assembly time and testing time are reduced and the price is reduced as compared to conventional three port valves when two three port valves would be needed to perform the same function. In the present invention the pressurized fluid supply port and the exhaust port are the same for the dual valve operation; thus, the piping cost at the Customer's site is also reduced. Using two normally closed control valves with the present invention enables the dual piston pilot valve of the present invention to function as a normally open three port valve or a pressure center double solenoid four point valve. Using two normally open control valves enables the present invention to function as a normally closed three port pilot valve or an exhaust type double solenoid four point valve.

One object of the present invention is to provide a dual piston pilot valve for accomplishing the same results as two conventional three port pilot valves with reduced man hours for assembly and testing and a reduced price.

Another object of the present invention is to provide a one piece dual piston pilot valve which is versatile and can perform the functions associated with multiple three port pilot valves; thus, reducing the customer's inventory of pilot valves needed for various applications.

According to one feature of the present invention a dual piston pilot valve has a housing forming first and second cylinders, a first piston moveable in the first cylinder, a second piston moveable in the second cylinder, a single pressurized fluid supply port communicating with both the first and second cylinders, a first output port communicating with the first cylinder, a second output port communicating with the second cylinder, a single exhaust port communicating with both the first and second cylinders. A first control valve communicates with the single pressurized fluid supply port to move the first piston to open passage between the single pressurized fluid supply port and the first output port and communicates with the first cylinder to move the first piston to open passage between the single exhaust port and the first output port, and a second control valve communicates with the single pressurized fluid supply port to move the second piston independent of the first piston to open passage between the single pressurized fluid supply port and the second output port and communicates with the second cylinder to move the second piston independent of the first piston to open passage between the single exhaust port and the second output port.

Yet another feature of the present invention is that the first cylinder includes a first output chamber having a first axially upwardly facing seat and a first axially downwardly facing seat, and the second cylinder includes a second output chamber having a second axially upwardly facing seat and a second axially downwardly facing seat. Further, each piston includes an upper seal for engaging the first and second axially downwardly facing seats independently to close passage between the first output port and the single exhaust port and the second output port and the single exhaust port.

An additional feature of the present invention is that each piston includes a lower seal for engaging the first and second axially upwardly facing seats independently to close passage between the first output port and the single pressurized fluid supply port and the second output port and the single pressurized fluid supply port.

In one aspect of the present invention a first compression spring engages the first piston and biases the first piston upwardly so that the upper seal engages the first downwardly facing seat of the first output chamber to close passage between the first output port and the single exhaust port and to open passage between the first output port and the single pressurized fluid port.

In another aspect of the present invention a second compression spring engages the second piston and biases the second piston upwardly so that the upper seal engages the second downwardly facing seat of the second output chamber to close passage between the second output port and the single exhaust port and to open passage between the second output port and the single pressurized fluid port.

In a further aspect of the present invention a first spool engages the first piston to move the first piston in response to communication between the first control valve and the first cylinder to cause the lower seal of the first piston to engage the first upwardly facing seat in the first output chamber to close passage between the single pressurized fluid port and the first output port and open passage between the single exhaust port and the first output port. And yet another aspect of the present invention, a second spool engages the second piston for moving the second piston in response to communication between the second control valve and the second cylinder to cause the lower seal of the second piston to engage the second upwardly facing seat in the second output chamber to close passage between the single pressurized fluid port and the second output port and open passage between the single exhaust port and the second output port.

In yet another aspect of the present invention, the first and second control valves may be either normally closed or normally open valves. Using a normally closed control valve produces a normally open passage between the output ports and the single pressurized fluid port and a normally closed passage between the output ports and the single exhaust port. Using a normally open control valve produces a normally open passage between the output ports and the single exhaust port and a normally closed passage between the output ports and the single pressurized fluid port.

Additional objects, advantages, and novel features of the invention are set forth in the description as follows, and will become apparent to those skilled in the art upon reviewing the drawings in connection with the following description.

DETAILED DESCRIPTION OF PREFERRED EMBODIMENTS OF THE INVENTION

Figure 1:
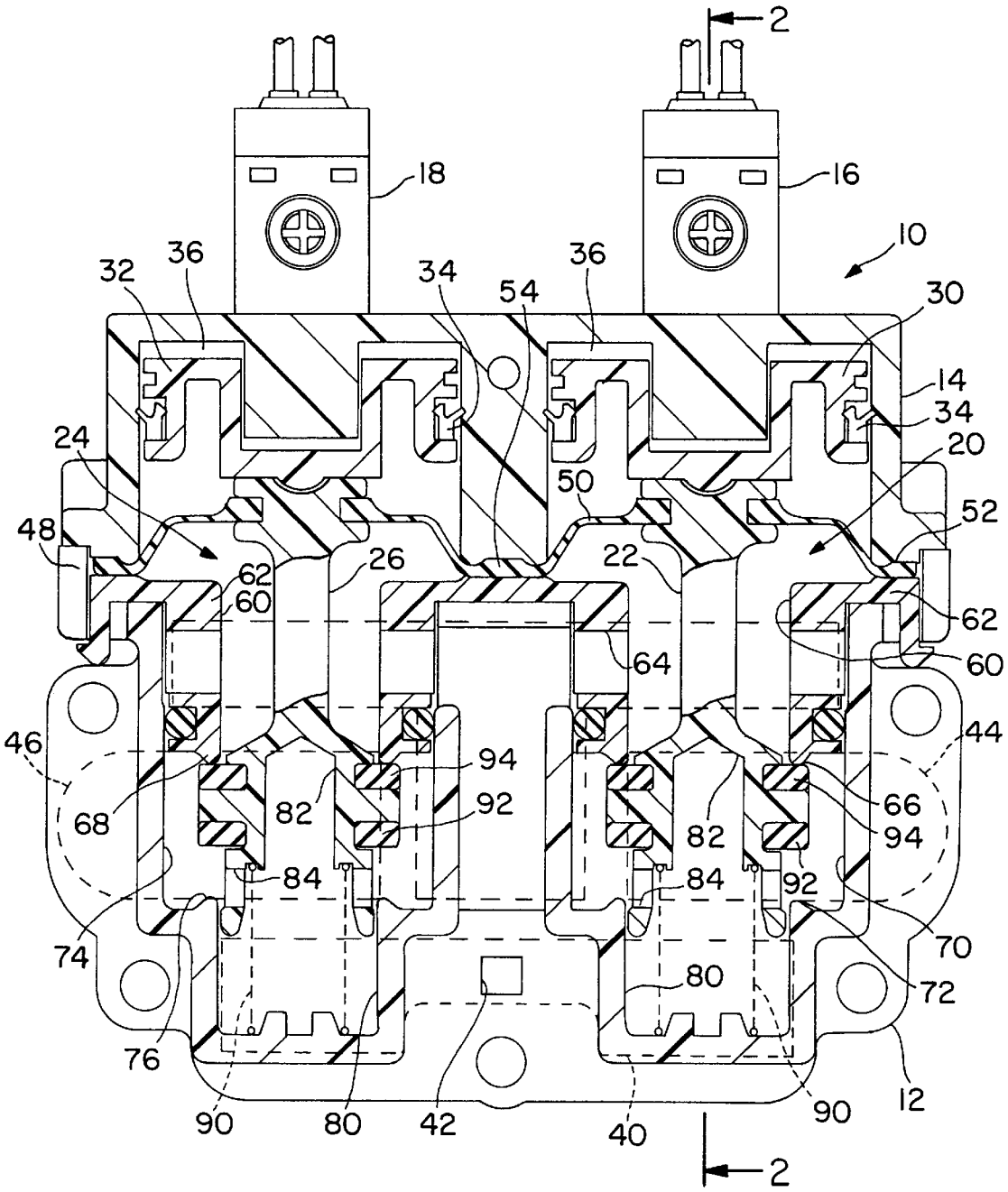
FIG. 1 is a cross-sectional view of the dual piston pilot valve according to the present invention with the pressurized fluid supply port, first and second output ports, and exhaust port shown with dotted lines.

Referring. to FIG. 1, a dual piston pilot valve 10 having dual pistons extending and retracting using pressurized fluid is shown. The pilot valve 10 includes a bottom housing 12 and a top housing 14 which are connected using conventional connection devices such as screws. Mounted to the top of the top housing 14 is a first solenoid actuated pressurized fluid control valve 16 and a second solenoid actuated pressurized fluid control valve 18. Control valves 16 and 18 may be any conventional solenoid actuated pressurized fluid control valve. Preferably control valves 16 and 18 are control valves having Model No. SY114-6L0 manufactured by SMC Corporation. As will be explained, control valves 16 and 18 may be either normally closed valves or normally open valves.

Figure 2:
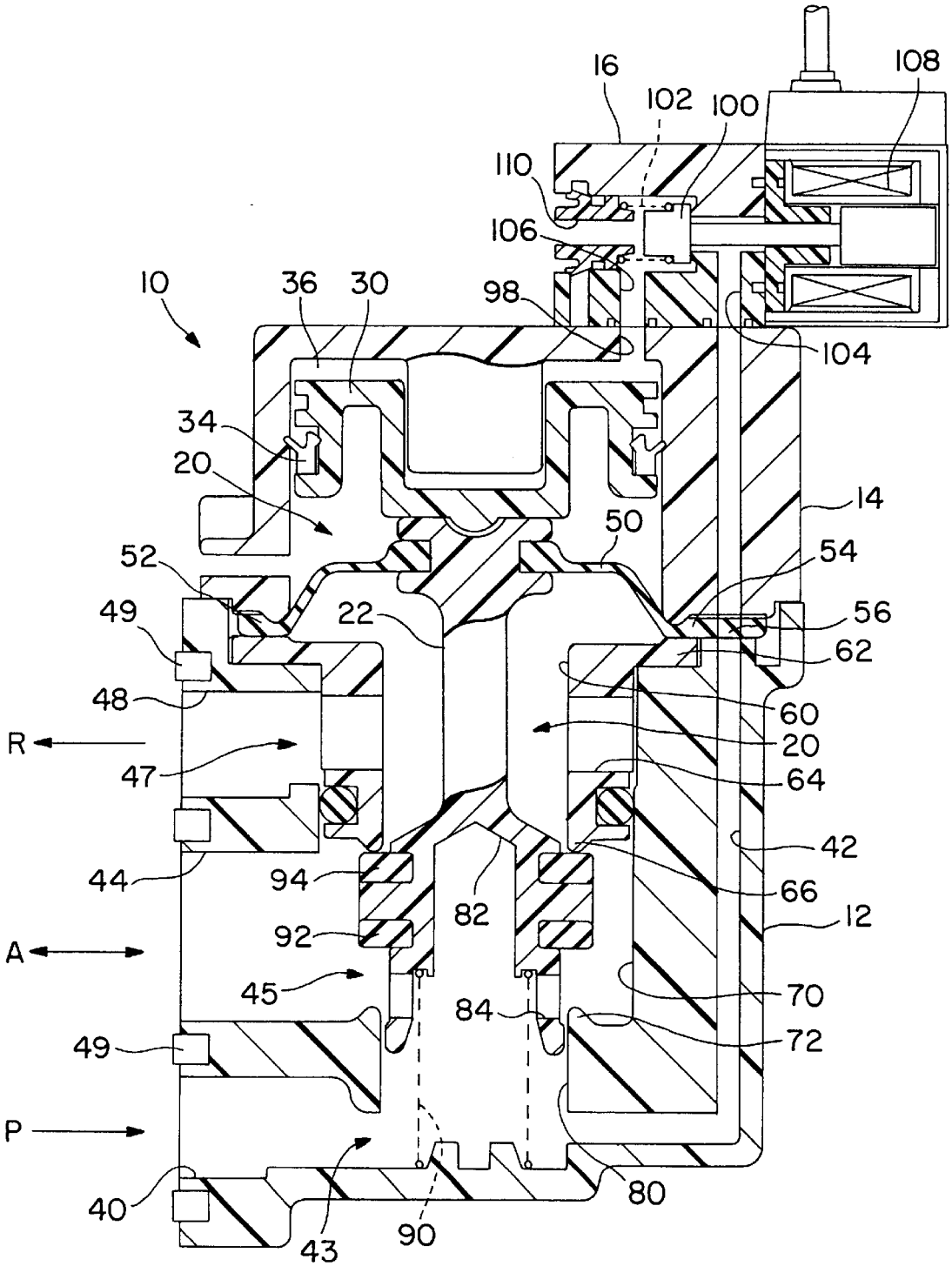
FIG. 2 is a cross-sectional view of FIG. 1 taken along lines 2—2 in FIG. 1 and, FIG. 3 is a sectional view of a control valve which is normally open.
Figure 3:
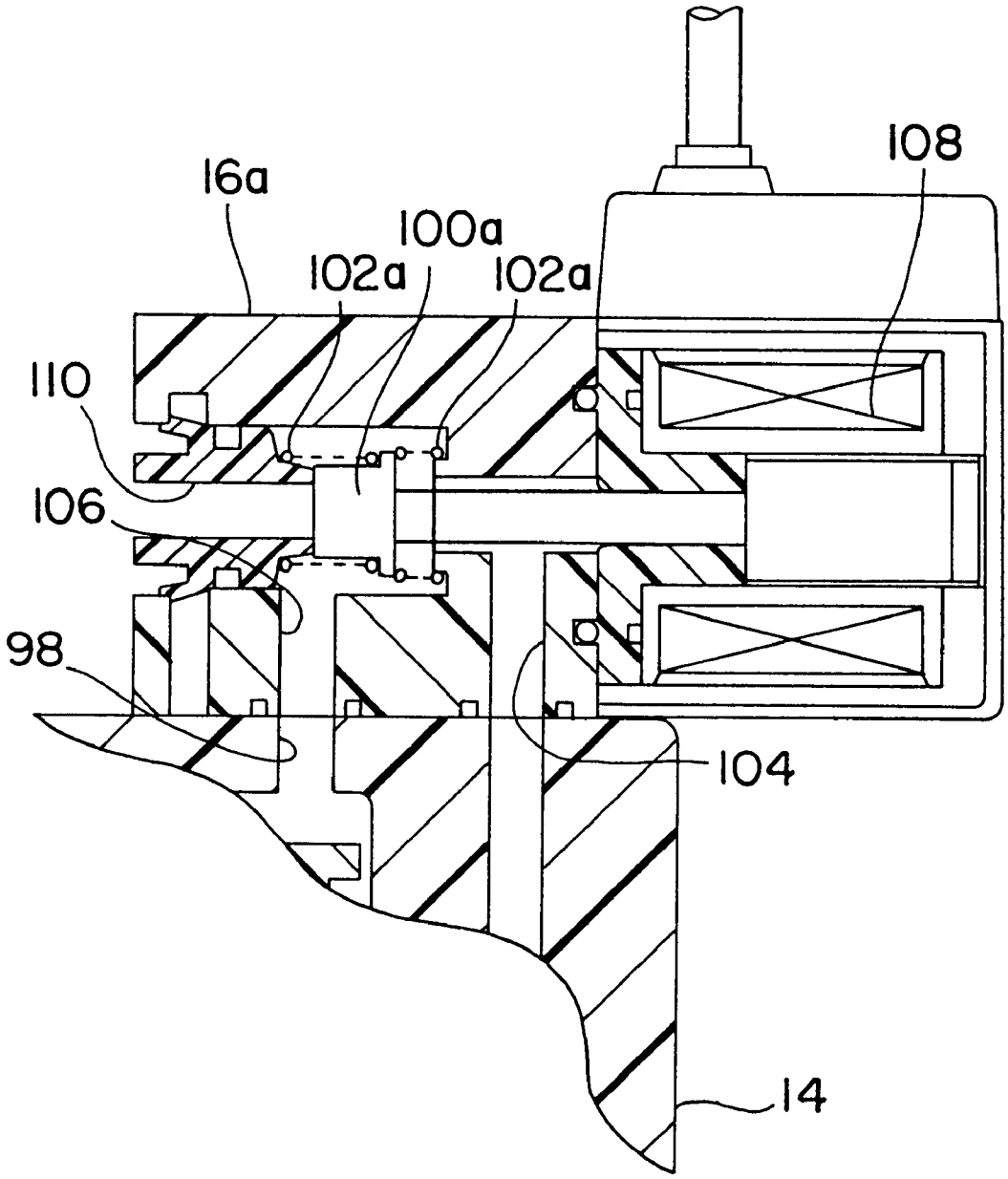

As shown in FIGS. 1 and 2 the bottom and top housings 12, 14 form a first cylinder 20 and a second cylinder 24. A first piston 22 is movably retained in the first cylinder 20 and a second piston 26 is movably retained in the second cylinder 24.

A first spool 30 engages an upper surface of the first piston 22 and includes a circumferential seal 34 engaging the inner surface of the first cylinder 20 to form a first fluid cavity 36 in the first cylinder 20 above the spool 30. A second spool 32 engages an upper surface of the second piston 26 and also includes a seal 34 engaging the internal surface of the second cylinder 24 to form a second fluid cavity 38 above the spool 32.

Continuing to refer to both FIGS. 1 and 2, the bottom housing 12 forms a single pressurized fluid supply port 40 in fluid communication with both the first and second cylinders 20, 24. A pressurized fluid supply passageway 42 extends through the bottom housing 12 and top housing 14 and is in fluid communication with the pressurized fluid supply port 40 and the pressurized fluid control valves 16 and 18. The fluid supply passageway 42 and the single pressurized fluid supply port 40 are in fluid communication with the first and second cylinders 20, 26 through openings 43 (as shown in FIG. 2 for first cylinder 20). Thus, the flow of pressurized fluid through pressurized fluid port 40 is controlled independently by valves 16 and 18.

A first output port 44 communicates with the first cylinder 20 through opening 45 in the first cylinder 20 (as shown in FIG. 2) and a second output port 46 communicates with the second cylinder 24 through a corresponding opening in the second cylinder 24 (not shown).

A single exhaust port 48 communicates with the first cylinder 20 through opening 47 in the first cylinder 20 (as shown in FIG. 2) and the second cylinder 24 through a corresponding opening in the second cylinder 24 (not shown) and is formed in the bottom housing 12.

The single pressurized fluid supply port 40, the first and second output ports 44, 46; and the single exhaust port 48 are matched with ports on devices to be controlled by the pilot valve 10 and the coupling is sealed using a gasket 49 shown in FIG. 2.

A diaphragm 50 has two portions for engaging first piston 22 and second piston 26 and permitting independent movement of pistons 22, 26. Diaphragm 50 is made from a rubber material and includes an outer flange 52 which is retained between the bottom housing 12 and top housing 14 and a central flange 54 which includes an opening 56 aligned with the pressurized fluid supply passageway 42. Diaphragm 50 divides the first and second cylinders 20, 24 to preclude pressurized fluid supplied through passageway 42 from entering the upper part of the first and second cylinders 20, 24 which include the first and second spools 30, 32. The diaphragm 50 avoids contamination of the pressurized fluid being supplied through passageway 42 from fluid and other contaminants in the cavities 36, 38 in the upper part of the first and second chambers cylinders 20, 24 associated with the first and second spools 30, 32.

The first and second cylinders 20, 24 each include an exhaust chamber 60 formed by exhaust member 62 having exhaust openings 64 which communicates with openings 47 to provide communication between the single exhaust port 48 and the first and second cylinders 20, 24.

The first cylinder 20 includes a first output chamber 70 and the second cylinder 24 includes a second output chamber 74. The first output chamber 70 includes a first axially downwardly facing valve seat 66 formed by the exhaust member 62 retained in the first cylinder 20. The second output chamber 74 includes a second axially downwardly facing valve seat 68 formed by the exhaust member 62 retained in the second cylinder 24.

The first output chamber 70 also includes a first axially upwardly facing valve seat 72 formed by the bottom housing 12. The second output chamber 74 includes a second axially upwardly valve seat 76 formed by the bottom housing 12. As will be explained later, these valve seats 66, 68, 72 and 76 are used to provide open and closed passages through openings 45 between the single pressurized fluid supply port 40 and the first and second output ports 44 and between the first and second output ports 44 and the single exhaust port 48.

The bottom housing 12 forms two pressurized fluid chambers 80 within the first and second cylinders 20, 24, respectively. Each of the pressurized fluid chambers 80 communicates with the pressurized fluid supply passageway 42 and with the pressurized fluid supply port 40 through opening 43. Thus, first and second cylinders 20, 24 are in fluid communication with the pressurized fluid supply passageway 42 and with the pressurized fluid supply port 40. Each piston 22, 26 includes a pressure cavity 82 opening downward into the pressurized fluid chambers 80 at the opposite end of the pistons 22, 26 from the spools 30, 32. Each of the pistons 22, 26 also includes pressurized fluid openings 84 providing fluid communication between pressurized fluid chambers 80 and the first and second output ports 44, 46. As shown in the figures, pressurized fluid openings 84 are located in the pistons 22, 26 at the lower edge of pressure cavities 82.

A bottom seal 92 and a top seal 94 are located on both the first and second pistons 22, 26. The bottom seals 92 engage the first and second axially upwardly facing valve seats 72 and 76 and the top seals 94 engage the first and second axially downwardly facing seats 66, 68 in the first and second output chambers 70, 74 respectively.

Each of the first and second pistons 22, 26 is biased upwardly by compression springs 90 retained in the first and second cylinders 20, 24 to force top seals 94 against the first and second axially downwardly facing valve seats 72, 76 in the first and second output chambers 70, 74. The biasing of the compression springs 90 to force top seals 94 against the first and second axially downwardly facing seats 60, 68 creates a normally open passage through pressure openings 84 and opening 43 and 45 between the single pressurized fluid supply port 40 and the first and second output ports 44, 46.

As best shown in FIG. 2, top housing 14 forms two input/output passageways 98 providing communication between the first and second control valves 16 and 18 and the cavities 36 and 38 respectively. One of the input/output passageways 98 communicates with the cavity 36 formed in the first cylinder 20 by the first spool 30 and the other input/output passageway 98 communicates with the cavity 38 formed in the second cylinder 24 by the second spool 32. Input/output passageways 98 serve to exhaust gas or fluid in cavities 36, 38 when pistons 22, 26 are biased upwardly by springs 90. Input/output passage ways 98 also provide communication with control valves 16, 18 to permit introduction of fluid or gas into cavity 36 to force spools 30, 32 and pistons 22, 26 downwardly against the bias of springs 90. Upon introduction of fluid or gas through input/output passageway 98 the bottom seals 92 on the pistons 22, 26 are forced against the first and second axially upwardly facing valve seats 72, 76 in the first and second output chambers 70, 74 to close the passage between the single pressurized fluid supply port 40 and the first and second output ports 44, 46 and open passage way between the first and second output ports 44, 46 and the single exhaust port 48.

It will be appreciated that control valves 16 and 18 are operated independently of each other and therefore the control of pistons 22, 26 is independent to create different open and close relationships between the single pressurized fluid supply port 40, the first and second output ports 44, 46 and the single exhaust port 48 for the first and second cylinders 20, 24. In other words, the first cylinder 20 control valve 16 could be operated to create an open passage between the single pressurized fluid supply port 40 and the first output port 44 and a closed passage between the first output port 44 and the exhaust port 48. At the same time control valve 18 can be operated to create a closed passage between the single pressurized fluid supply port 40 and the second output port 46 and an open passage between the second output 46 and the single exhaust port 48.

Referring to FIG. 2, the control valves 16, 18 include a piston 100, a compression spring 102 engaging the piston, a pressurized fluid passageway 104 communicating with the pressurized fluid supply passageway 42, and inputoutput passageway 106 communicating with the input/output passage way 98 in the top housing 14, a solenoid 108 for actuating the piston 100, and an output port 110. As shown in FIG. 2, the control valve 16 is in a normally closed position permitting the flow of pressurized fluid into pressurized fluid supply passageway 42 such that the first piston is biased upwardly to seat upper seal 94 against the axially downwardly facing seat 66. Thus, a normally closed control valve 16 produces a normally open passage between the pressurized fluid supply port 40 and the first output port 44 and a normally closed passage between first output port 44 and the exhaust port 48. It will be understood that control valves may also be normally open in which case fluid or gas would be forced into cavity 36 causing downward movement of piston 22 to seat bottom seal 92 against the axially upwardly facing seat 72. Use of a normally open control valve 16 would thus create a normally closed passage between pressurized fluid supply port 40 and the first output port 44 and a normally open passage between the first output port 44 and the single exhaust port 48.

It will be understood that various modifications can be made to the apparatus disclosed in this application without changing the scope of the invention as set forth in the claims attached hereto.

What is claimed is:

1. A dual piston pilot valve comprising:

a housing forming first and second cylinders, a first piston having a first seal region and moveable in the first cylinder, a first spool moveable in the first cylinder for engaging the first piston to effect movement of the first piston, a second piston having a second seal region and moveable in the second cylinder, a second spool moveable in the second cylinder for engaging the second piston to effect movement of the second piston, a single pressurized fluid supply port communicating with both the first and second cylinders, a first output port communicating with the first cylinder, a second output port communicating with the second cylinder, a single exhaust port communicating with both the first and second cylinders, a diaphragm engaging the housing and both the first and second pistons, the diaphragm being positioned between both the first and second spools and both the first and second seal regions of the first and second pistons to effect a seal between the single exhaust port and the first and second spools, a first control valve communicating with the single pressurized fluid supply port to move the first piston to open fluid passage between the single pressurized fluid supply port and the first output port and communicating with the first cylinder to move the first piston to open fluid passage between the single exhaust port and the first output port, and a second control valve communicating with the single pressurized fluid supply port to move the second piston to open fluid passage between the single pressurized fluid supply port and the second output port and communicating with the second cylinder to move the second piston to open fluid passage between the single exhaust port and the second output port, wherein the first control valve effects movement of the first piston independent of the movement of the second piston, and the second control valve effects movement of the second piston independent of the movement of the movement of the first piston.

2. The valve of claim 1 wherein the first cylinder includes a first output chamber having a first axially upwardly facing seat and a first axially downwardly facing seat and the second cylinder includes a second output chamber having a second axially upwardly facing seat and a second axially downwardly facing seat.

3. The valve of claim 2 wherein each piston includes an upper seal for engaging the first and second axially downwardly facing seats independently to close fluid passage between the first output port and the single exhaust port and the second output port and the single exhaust port.

4. The valve of claim 3 wherein each piston includes a lower seal for engaging the first and second axially upwardly facing seats independently to close fluid passage between the first output port and the single pressurized fluid supply port and the second output port and the single pressurized fluid supply port.

5. The valve of claim 4 further comprising a first compression spring engaging the first piston and biasing the first piston upwardly so that the upper seal of the first piston engages the first axially downwardly facing seat of the first output chamber to close passage between the first output port and the single exhaust port and to open passage between the first output port and the single pressurized fluid supply port.

6. The valve of claim 5 further comprising a second compression spring engaging the second piston and biasing the second piston upwardly so that the upper seal of the second piston engages the second axially downwardly facing seat of the second output chamber to close passage between the second output port and the single exhaust port and to open passage between the second output port and the single pressurized fluid supply port.

7. The valve of claim 6, wherein the first spool engaging the first piston for moving the first piston in response to communication between the first control valve and the first cylinder causes the lower seal the first piston to engage the first upwardly facing seat in the first output chamber to close passage between the single pressurized fluid supply port and the first output port and to open passage between the single exhaust port and the first output port.

8. The valve of claim 7, wherein the second spool engaging the second piston for moving the second piston in response to communication between the second control valve and the second cylinder causes the lower seal of the second piston to engage the second upwardly facing seat in the second output chamber to close passage between the single pressurized fluid supply port and the second output port and to open passage between the single exhaust port and the second output port.

9. The valve of claim 1 wherein at least one of the first and second control valves is normally closed whereby the respective at least one of the first and second output ports has a normally open passage with the single pressurized fluid supply port and a normally closed passage with the single exhaust port.

10. The valve of claim 1 wherein at least one of the first and second control valves is normally open whereby the respective at least one of the first and second output ports has a normally open passage with the single exhaust port and a normally closed passage with the single pressurized fluid supply port.

* * * * *